United States Patent [19]

Ikawa et al.

[11] 4,024,542

[45] May 17, 1977

[54] ANTENNA MOUNT FOR RECEIVER CABINET

[75] Inventors: Junzo Ikawa, Chigasaki; Tokuji Aramaki; Yasuo Naitoh, both of Fujisawa, all of Japan

[73] Assignee: Matsushita Electric Industrial Co., Ltd., Osaka, Japan

[22] Filed: Dec. 24, 1975

[21] Appl. No.: 644,331

[30] Foreign Application Priority Data

Dec. 25, 1974 Japan ..... 49-3385[U]
Jan. 14, 1975 Japan ..... 50-6706[U]

[52] U.S. Cl. ..... 343/702
[51] Int. Cl.[2] ..... H01Q 1/24
[58] Field of Search ..... 343/702, 884, 906

[56] References Cited

UNITED STATES PATENTS

| | | | |
|---|---|---|---|
| 2,582,159 | 1/1952 | Race | 343/906 |
| 3,946,317 | 3/1976 | Ishimaru | 343/702 |

*Primary Examiner*—Eli Lieberman
*Attorney, Agent, or Firm*—Stevens, Davis, Miller & Mosher

[57] ABSTRACT

An antenna apparatus for use in a television receiver set or the like is provided. The apparatus has an antenna body which comprises a hollow resin cover having a plug pin integrally formed at one end thereof and an antenna pipe provided at other end thereof. An elastic conductor is mounted in the resin cover for electrically connecting the plug pin with the antenna pipe. The antenna body thus constructed can be detachably mounted on the television receiver set.

2 Claims, 4 Drawing Figures

ANTENNA MOUNT FOR RECEIVER CABINET

FIELD OF THE INVENTION

The present invention relates to an antenna apparatus for a television receiver set or the like.

SUMMARY OF THE INVENTION

It is a first object of the present invention to enable an antenna body to be detachably mounted on a television receiver set.

It is a second object of the present invention to prolong the durability of the antenna body and facilitate the assembling of the body by providing an elastic conductor in a resin cover for electrically connecting an antenna pipe with a plug pin.

It is a third object of the present invention to provide an antenna apparatus which assures no wear produced between the antenna body and the television receiver set when the antenna body is repeatedly inserted into and detached from the television receiver set any time, to thereby always assure stable mounting of the antenna.

According to the present invention, the following advantages are provided:

1. The structure of the antenna is simplified and hence the cost can be reduced.
2. The antenna can be detached when it is not required to be mounted on the television receiver set.
3. The antenna is held by an air-socket the structure of which is similar to that of an earphone jack. The antenna can be held more rigidly by forming a groove on the cover of the antenna body and fitting a separate elastic holding member into the groove. Accordingly, the antenna is not readily detached from the television receiver set when it is pulled, although it is pivotably mounted on the television receiver set.
4. The antenna is not readily inclined because a cylindrical recess of the case has the same diameter as that of the antenna.
5. Since the cover of the antenna body, which is to be gripped by an operator handling the antenna, is made from resinous material, the manufacture of the antenna body is facilitated and the generation of rust on the antenna body due to touching by the hand can be prevented. Furthermore, when the antenna body is to be fitted into a portion of a resin molded cabinet of the television receiver set, damage to the antenna body due to the repetitive insertion and removal operation can be prevented.

DESCRIPTION OF THE PREFERRED EMBODIMENTS

One embodiment of the present invention will now be explained in conjunction with the present invention.

Figure 1:
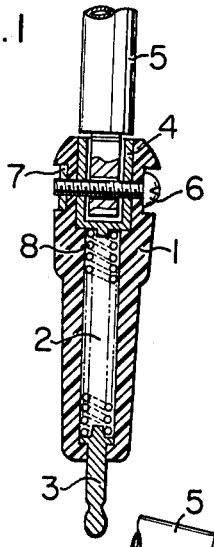
FIG. 1 is a sectional view of an antenna apparatus in one embodiment of the present invention.

Referring to FIG. 1, a resin cover 1 includes a longitudinally extending through-hole 2 at the center thereof, and a plug pin 3 is integrally attached to one open end of the resin cover 1. An antenna pipe support member 4 is mounted at the other open end of the resin cover 1. An antenna pipe 5 has its base end inserted into the antenna pipe support member 4. A bolt 6 and a nut 7 serves to affix the antenna pipe support member 4 and the antenna pipe 5 to the resin cover 1. In this instance, the antenna pipe 5 is pivotably mounted with respect to the bolt 6. A coiled spring 8 is positioned in the through-hole 2 between the antenna pipe support member 4 and the plug pin 7 and it abuts against the antenna pipe support member 4 and the plug pin 7 resiliently to electrically connect the support member 4 with the plug pin 7.

With the above construction, the antenna pipe 5 is electrically connected to the plug pin 3 through the bolt 6, the antenna pipe support member 4 and the coiled spring 8. Although not shown in FIG. 1, the television receiver set is provided with a recess in which a base of the resin cover 1 is inserted to be held therein and a terminal to which the plug pin 3 is to be electrically connected.

With the above construction, since the cover 1 is a molded resin instead of being made of metal, the cover will not rust even when the cover 1 is touched by hand when it is mounted and removed. Furthermore, because the cabinet which constitutes the television set is usually made from resinous material and the cover 1 is also made from resinous material, the wear between the cabinet and the cover 1, which would otherwise occur during frequent insertion and removal operations, can be avoided, resulting in the prolongation of the durability of the resin cover 1 and the cabinet. Moreover, the assembly of the resin cover 1 per se is facilitated.

In addition, since the antenna pipe support member 4 and the plug pin 3 are not integrally formed but the coiled spring 8 is disposed therebetween to electrically connect them both, the positioning of a bolt hole formed in the resin cover 1 and a bolt hole formed in the antenna support member 4 is facilitated. Further, the variance in distance between the antenna support member 4 and the plug pin 3 due to the variance in dimension of the resin cover 1, if any, can be absorbed by the coiled spring 8.

Figure 2A:
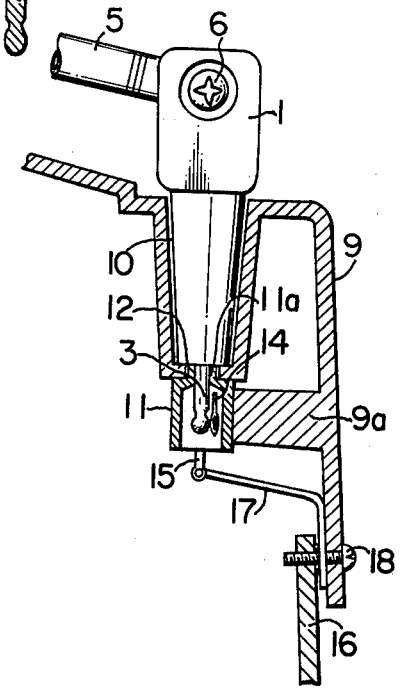
FIG. 2A is a side sectional view showing the antenna body of FIG. 1 mounted on a cabinet.
Figure 2B:
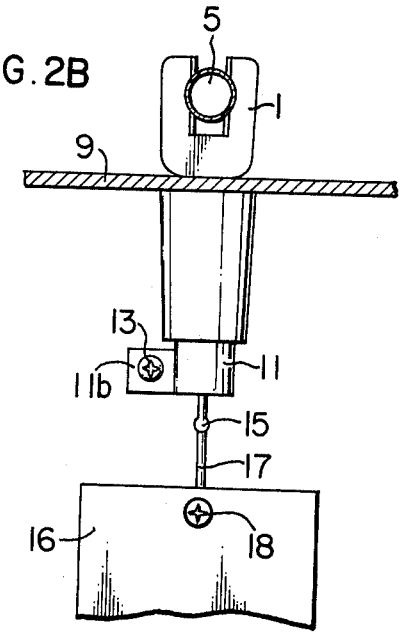
FIG. 2B is a front sectional view of FIG. 2A.

FIGS. 2A and 2B show the antenna body of the above construction which is mounted on the cabinet. In the drawings, the same reference numerals are used to represent the same parts as in FIG. 1.

In the drawings, the cabinet 9 has a recess 10 formed at a portion thereof for holding the base of the resin cover 1 while it is inserted into the recess 10. A bottom surface of the recess 10 is formed with a hole 12 into which a fixed axis of a socket 11 similar to an earphone jack is to be fitted. The socket 11 is integrally formed with a socket mount 11*b* as shown in FIG. 2B. The cabinet 9 is integrally formed with a boss 9*a*. When mounting the socket 11 on the cabinet 9, the socket mount 11*b* is fixed to the boss 9*a* by a bolt 13 while the fixed shaft 11*a* of the socket 11 is fitted into the hole 12. A holding member 14 in the socket 11 has a mechanical structure which is similar to the earphone jack for holding an earphone plug and a terminal 15 projects outwardly of the socket 11. An antenna terminal board 16 is provided and a conductive member 17 such as a lead wire or metal member has its one end fixed to the terminal 15 by soldering or the like. A bolt 18 is provided for electrically connecting the other end of the conductive member 17 and the antenna terminal board 16 and for fixing the conductive member 17 and the antenna terminal board 16 to the cabinet 9.

With the above construction, by inserting the base of the resin cover 1 into the recess 10 of the cabinet 9, the antenna body can be held by the cabinet 9. Simultaneously, the plug pin 3 is inserted into the socket 11 to contact the holding member 14. In this manner, the plug pin 3 is electrically connected to the antenna terminal board 16 through the holding member 14, the terminal 15 and the conductive member 17. The antenna body is, of course, pivotably mounted with respect to the cabinet 9.

Accordingly, with the above construction, by merely inserting the resin cover 1 into the recess 10 of the cabinet 9, the electrical connection of the antenna pipe 5 with the antenna terminal board 16 is attained. Furthermore, since the antenna body can be removed from the cabinet 9 when it is not used, the antenna body is not objectionable. Moreover, since the plug pin 3 is held by the holding member 14 in the socket 11, the resin cover 1 will not be inadvertently detached from the cabinet 9.

Figure 3:
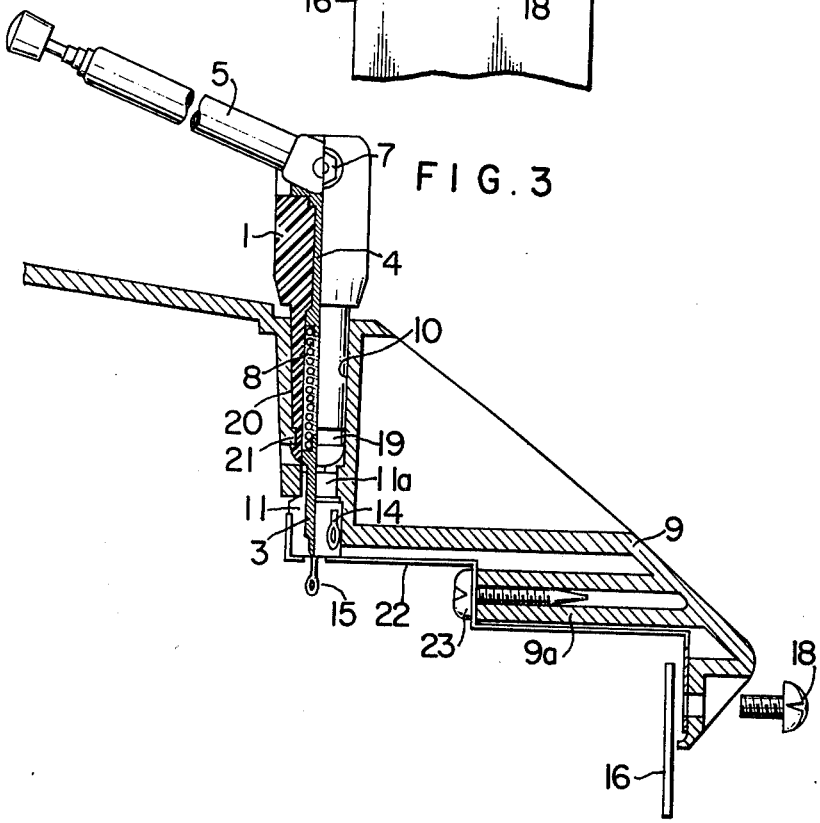
FIG. 3 is a side sectional view illustrating another method of mounting the antenna body on the cabinet.

FIG. 3 shows another embodiment. The same reference numerals are used to identify the parts common to those of FIGS. 1 and 2.

In FIG. 3, a ring groove 19 is formed around the outer periphery of the bottom of the resin cover 1, an elastic hold member 20 is formed on a side wall of the recess 10, and a projection 21 is formed at the free end of the elastic hold member 20 so as to be fitted into the groove 19. A metal member 22 is provided for fixing the socket 11 to the cabinet 9 and electrically connecting the terminal 15 of the socket 11 with the antenna terminal board 16. The metal member 22 is fixed at one end thereof to the terminal 15 by soldering and connected at the other end thereof to the antenna terminal board 16 by the bolt 18. The metal member 22 is thus fixed to the boss 9*a* by the bolt 23.

According to the above construction, in addition to the advantages obtainable by the construction of the embodiment shown in FIG. 2, the facilitation of manufacture is improved because the mounting of the socket 11 is completed simultaneously with the fixing of the metal member 22 to the boss 9*a*. Furthermore, since the terminal 15 and the metal member 22 are connected together by soldering, the fixing and electrical connection of them can be accomplished simultaneously, resulting in an improvement in the facilitation of manufacture. Moreover, since the projection 21 of the elastic holding member 20 is fitted into the groove 19 when the bottom of the resin cover 1 is inserted into the recess 10, the resin cover 1 can be pivotably held in the recess 10 and it will not be inadvertently detached by the fitting of the projection 21 into the groove 19.

What is claimed is:

1. An antenna apparatus for mounting on a cabinet having a recess therein comprising:

a. an antenna body including
   - a resin cover having a through-hole extending in an axial direction therethrough, said resin cover having a groove formed on the periphery thereof,
   - a plug pin fixed at one open end of said resin cover,
   - an antenna supporting member fixed at the other open end of said resin cover,
   - an antenna pipe pivotably mounted to said antenna supporting member, and
   - an elastic conductor disposed between said plug pin and said antenna supporting member, and b. an elastic holding member having a projection thereon formed on a side wall of the recess in said cabinet, said antenna body being rotatably held within said cabinet upon insertion of said resin cover into said recess, the projection on said elastic holding member fitting into the groove of said resin cover.

2. The antenna apparatus defined by claim 1, wherein said elastic conductor is a coiled spring.

* * * * *